US005528204A

United States Patent [19]

Hoang et al.

[11] Patent Number: 5,528,204

[45] Date of Patent: Jun. 18, 1996

[54] METHOD OF TUNING A CERAMIC DUPLEX FILTER USING AN AVERAGING STEP

[75] Inventors: Truc Hoang, Rio Rancho; Reddy R. Vangala, Albuquerque, both of N.M.

[73] Assignee: Motorola, Inc., Schaumburg, Ill.

[21] Appl. No.: 235,581

[22] Filed: Apr. 29, 1994

[51] Int. Cl.[6] ..... H01P 1/213; H01P 1/205

[52] U.S. Cl. ..... 333/134; 333/202; 333/207

[58] Field of Search ..... 333/202, 206, 333/207, 222, 223, 235, 134

[56] References Cited

U.S. PATENT DOCUMENTS 5,004,992 4/1991 Grieco et al. ..... 333/223 X 5,208,568 5/1993 Sassin ..... 333/207 X 5,422,610 6/1995 Heine et al. ..... 333/134

FOREIGN PATENT DOCUMENTS 0204602 11/1983 Japan ..... 333/223

0235801 10/1987 Japan ..... 333/202

*Primary Examiner*—Benny Lee

*Attorney, Agent, or Firm*—Gary J. Cunningham

[57] ABSTRACT

A method of tuning a duplex filter (500). First, the center frequency of at least one filter of a duplex filter (10) is measured (502). Next, the difference between the measured center frequency and a desired center frequency is determined (504). And, third the duplex filter is tuned (506) by selectively removing a substantially planar layer of dielectric material for a top surface (14) of the filter (10), whereby the frequency characteristics are modified.

6 Claims, 7 Drawing Sheets

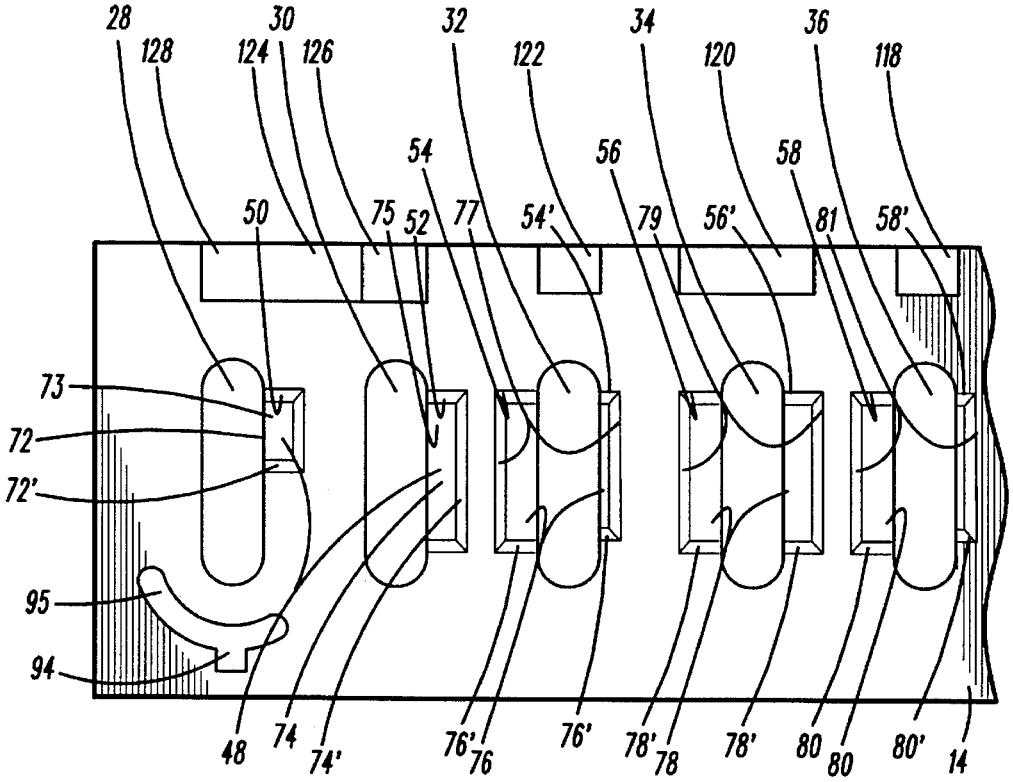
FIG. 3
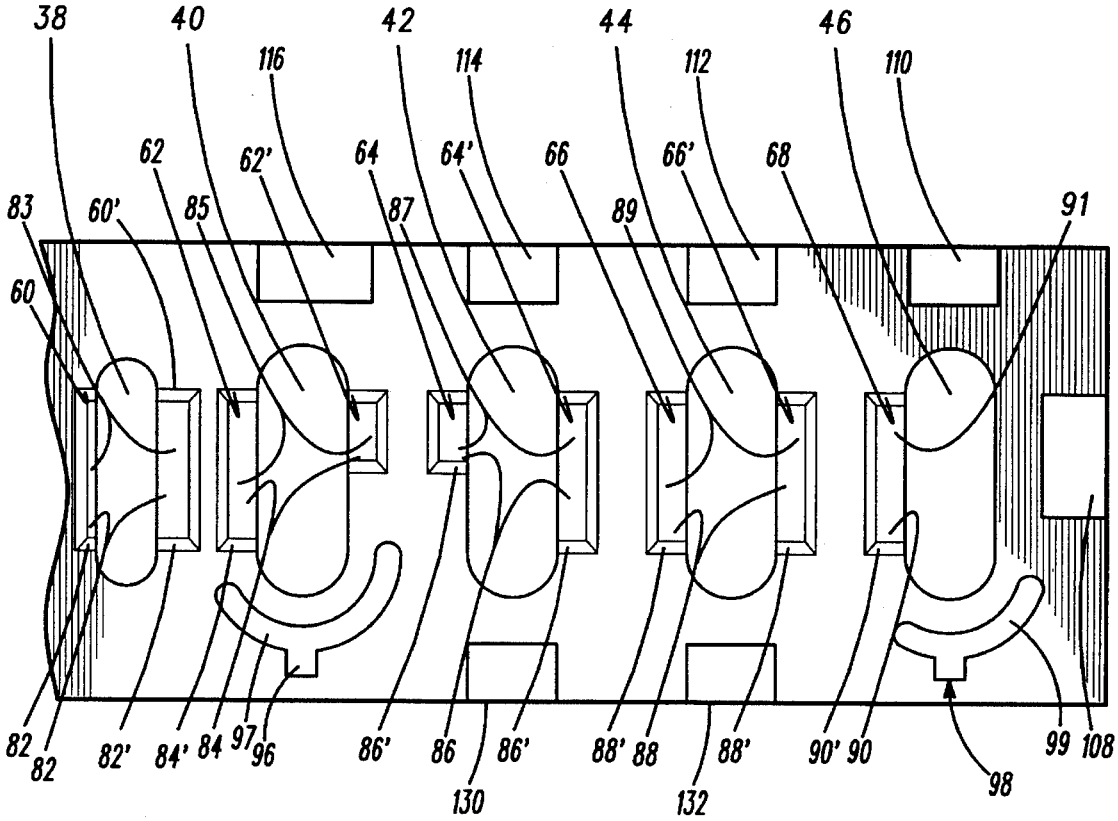

FIG. 8
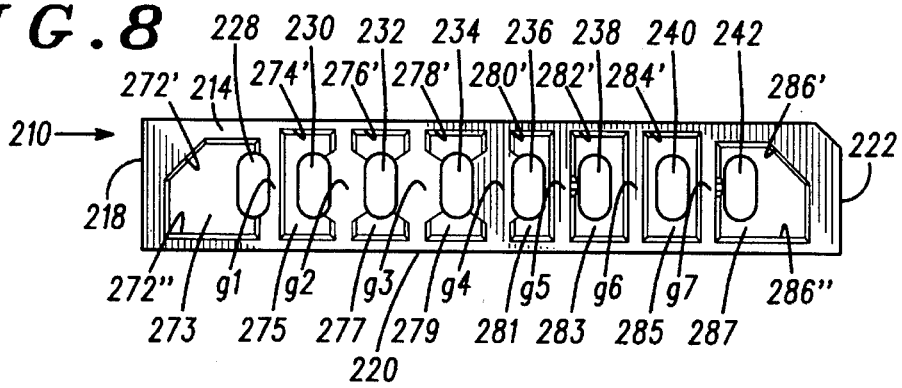
FIG. 6
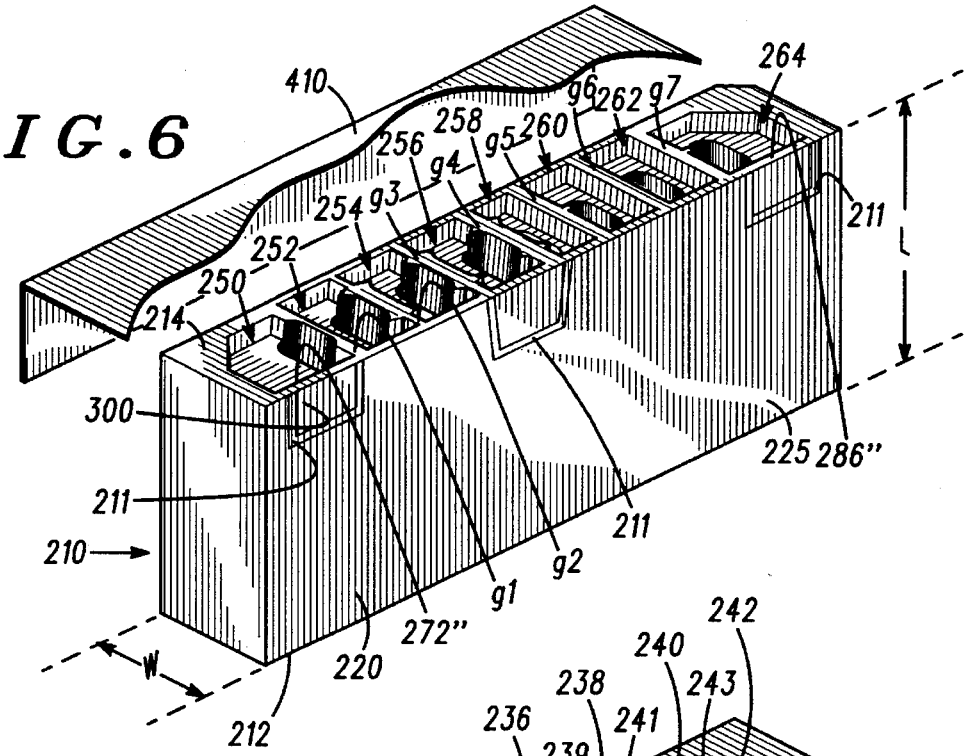
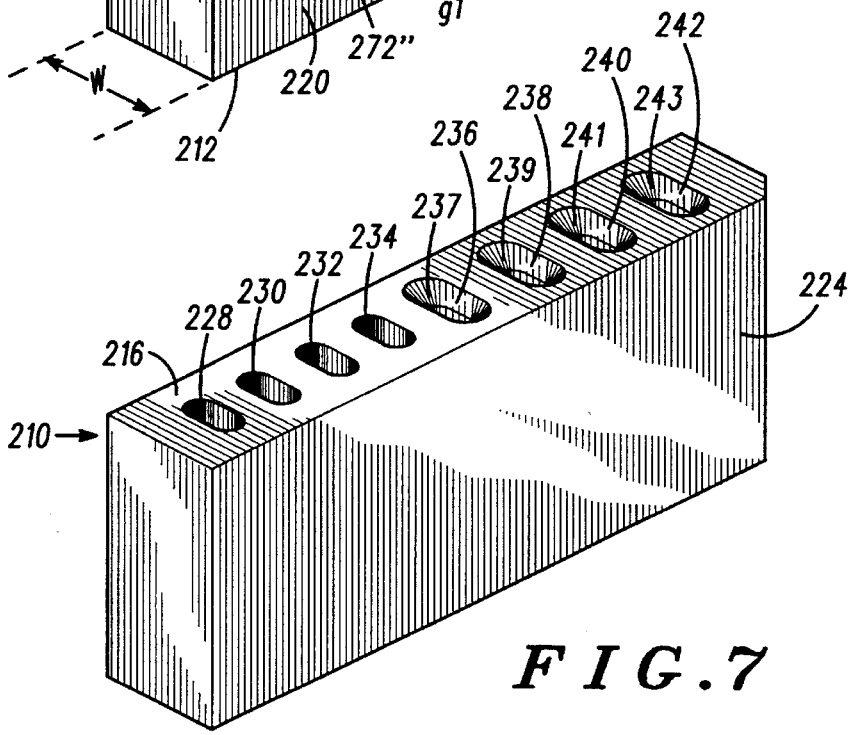
FIG. 7

METHOD OF TUNING A CERAMIC DUPLEX FILTER USING AN AVERAGING STEP

FIELD OF THE INVENTION

The present invention generally relates to ceramic filters and, in particular, to an improved method of tuning a ceramic duplex filter.

BACKGROUND OF THE INVENTION

Ceramic filters are known in the art. Prior art ceramic bandpass filters are generally constructed from blocks of ceramic material, and have various geometric shapes which are typically coupled to external circuitry through discreet wires, cables, pins or surface mountable pads.

Some of the major objectives in electronic designs are to reduce physical size, increase reliability, improve manufacturability and reduce manufacturing costs.

Prior art duplex filters generally require various metallization schemes on a top surface to provide the desired frequency response. These duplex filters are difficult to reliably manufacture on a consistent basis, because if the top metallization scheme is varied slightly, the frequency response can be undesirably altered. Moreover, these devices are difficult or require additional process steps to suitably tune. For example, prior art tuning requires removing the bottom metallization, grinding a portion of the ceramic off the bottom, then remetallizing the bottom surface of the ceramic and baking the duplexer to release the unwanted solvents, and thereafter sintering the newly metallized bottom.

For these reasons, a duplex filter which overcomes many of the foregoing deficiencies would be considered an improvement in the art. It would also be considered an improvement, if a method and duplex structure could be simplified to make the tuning and manufacturing process easier and more reliable.

BRIEF DESCRIPTION OF THE DRAWINGS

FIG. 3 is a top view of the duplex filter shown in FIG. 1, in accordance with the present invention.

FIG. 6 is an enlarged perspective view of an alternate embodiment of a duplex filter made in accordance with the present invention.

FIG. 7 is a bottom perspective view of the duplex filter shown in FIG. 6, in accordance with the present invention.

FIG. 8 is a top view of the duplex filter shown in FIG. 6, in accordance with the present invention.

DETAILED DESCRIPTION OF THE PREFERRED EMBODIMENT

Figure 1:
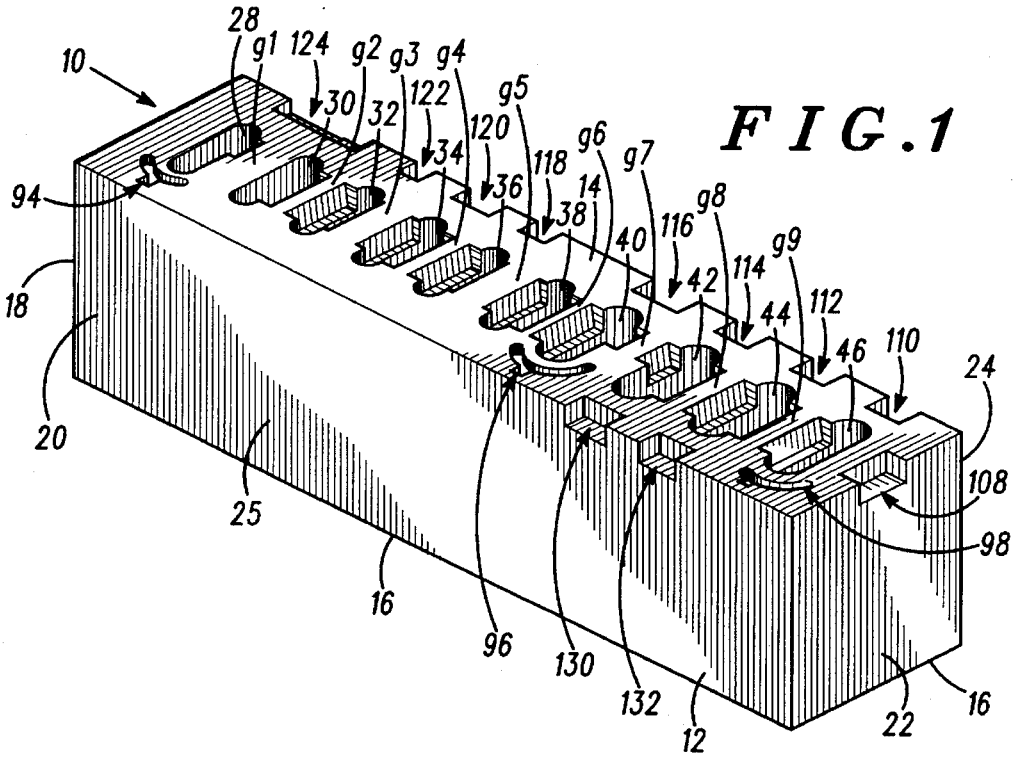
FIG. 1 shows an enlarged perspective view of a duplex filter made in accordance with the present invention.

The duplex filter 10 in FIGS. 1 and 3, includes a generally parallelpiped shaped filter body 12, comprising a block of dielectric material having a top 14, a bottom 16 and side surfaces 18, 20, 22 and 24, all being substantially planar. The filter body 12 also has a plurality of through-holes, including first through tenth through-holes 28, 30, 32, 34, 36, 38, 40, 42, 44 and 46, respectively, extending from the top surface 14 to the bottom surface 16. The filter body 12 in FIG. 3 also has a plurality of receptacles 48 corresponding to items 50, 52, 54 and 54', 56 and 56', 58 and 58', 60 and 60', 62 and 62', 64 and 64', 66 and 66' and 68, adjacent to the top surface 14, and of a suitable depth to receive a conductive material therein. Many of the exterior surfaces 16, 18, 20, 22 and 24 of the filter body 12 are substantially covered with conductive material defining a metallized layer 25, with the exception that the top surface 14 is substantially unmetallized.

The receptacles include a conductive layer of material sufficient to define a predetermined capacitance. In one embodiment, the conductive layers include several conductive layers, corresponding to items 72, 74, 76, 78, 80, 82, 84, 86, 88 and 90, respectively. These conductive layers are bound by substantially vertical walls 72', 74', 76', 78', 80', 82', 84', 86', 88' and 90' and horizontal floors 73, 75, 77, 79, 81, 83, 85, 87, 89 and 91 for each receptacle, respectively.

Figure 2:
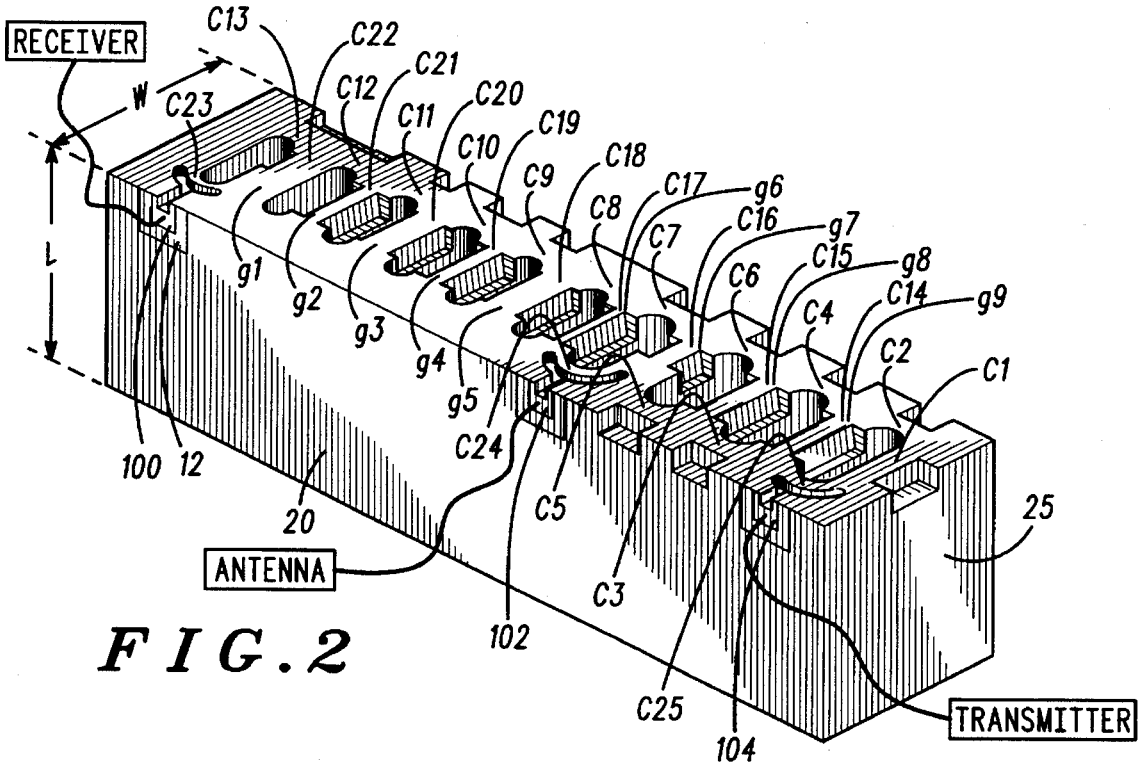
FIG. 2 is an alternate embodiment of the duplex filter shown in FIG. 1, in accordance with the present invention.

The duplex filter 10 further includes coupling devices for coupling signals into and out of the filter body 12, including substantially embedded capacitive devices 94, 96 and 98 for coupling to exterior components, such as external circuits, circuit boards, and the like. These devices 94, 96 and 98 are substantially surrounded by a non-conductive or dielectric material. The embedded capacitive devices 94, 96 and 98, are usually particularly adapted to being connected to a receiver, antenna and transmitter, respectively. In FIG. 2, the couplings 94, 96 and 98, include respective receiver, antenna and transmit pads 100, 102 and 104, respectively, on the front side surface 20. Each is immediately surrounded by the dielectric material of body 12.

This structure provides the advantage of strategically positioning the series capacitors near the top surface for adjustment of the zeroes and the shunt capacitors near the top surface for suitable placement of the poles at specific frequencies, to obtain the desired stopband and passband ripple response, respectively. The series, shunt and coupling capacitors are internal to and formed in filter body.

This structure provides a duplexer for simplified and more efficient and effective frequency tuning. This structure does not require complicated and unreliable top printing or connections to external components (capacitors).

More specifically, adjustment of the length L of the duplex filter herein, suitably adjusts the series, shunt and coupling capacitors, substantially simultaneously if desired, to provide a certain frequency response. This structure is in a compact and portable device, which can be reliably mass produced.

This design provides a three-dimensional structure in a duplex filter, below the top surface, which can be reliably manufactured, and simplifies the tuning process. In contrast, prior art duplex filters require complicated and exacting top printing of conductive patterns. They further require additional steps of removing and reapplying conductive coatings at the bottom surface. The instant design provides a simplified construction and reproducable design, which can also reduce manufacturing time, costs and process steps in making and tuning a duplex filter.

The through-holes generally each include respective receptacles adjacent to and immediately below the top surface 14. More particularly, each through-hole 28, 30, 32, 34, 36, 38, 40, 42, 44 and 46 includes an adjacent section 50, 52, 54, 56, 58, 60, 62, 64, 66 and 68, adjacent to and just below the top surfaces 14.

Figure 5:
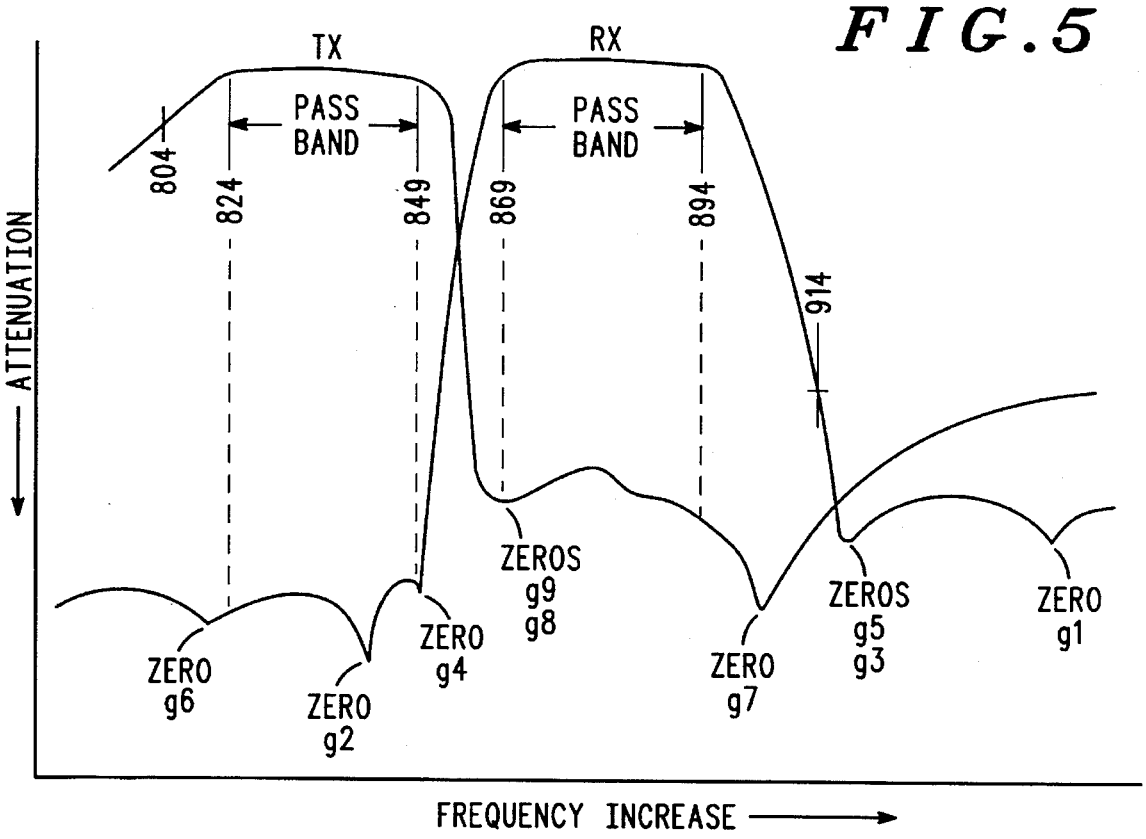
FIG. 5 is a representative frequency response of the duplex filter shown in FIG. 2, made in accordance with the present invention.

The through-holes 28, 30, 32, 34, 36 and 38 provide the receiver bandpass response of FIG. 5, while the through-holes 42, 44 and 46 provide the bandpass response of the transmit filter bandpass response. The through-hole 40 is shared by both the transmitter and receiver filters, and allows the two filters to be connected to a single antenna, as shown in FIG. 2.

Figure 4:
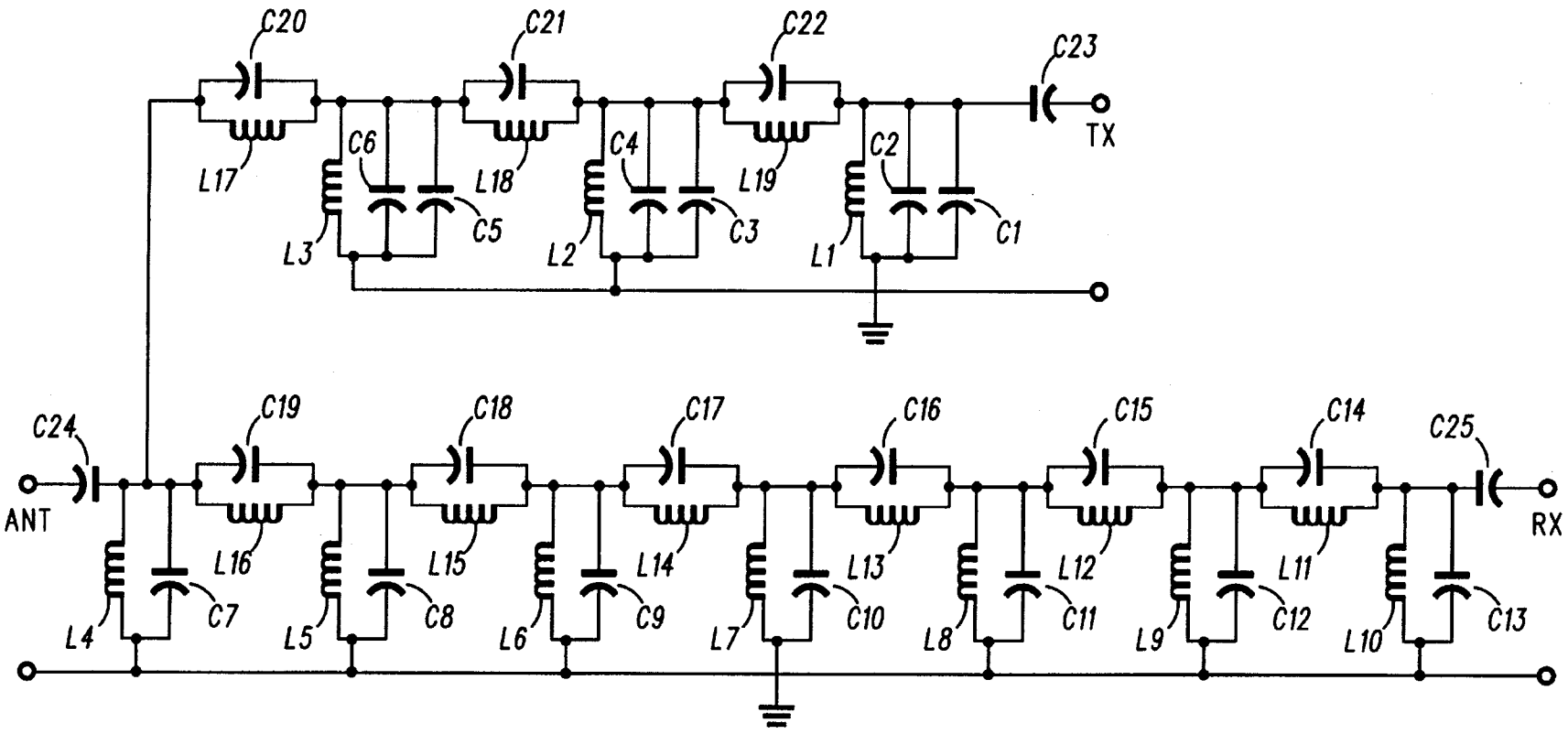
FIG. 4 is an equivalent circuit diagram of the duplex filter shown in FIGS. 1–3, in accordance with the present invention.

The receptacles 50–68 (inclusive) are utilized to provide a portion of the series capacitors shown in FIG. 4, as C14, C15, C16, C17, C18, C19, C20, C21, and C22, respectively. These capacitors are in parallel with their respective inductors L11, L12, L13, L14, L15, L16, L17, L18 and L19 of FIG. 4, to form so-called zeroes in FIG. 5. Most of these zeroes are used to increase attenuation at specific (undesirable) frequencies.

The receptacles define a generally funnel-shaped upper section of the through-holes, and each is at least partially complimentarily configured with a portion of at least one respective adjacent through-hole, sufficient to provide a predetermined capacitive coupling to at least one adjacent through-hole.

The opposing conductive facets of the adjacent funnel-shaped sections together with the dielectric material, defined as gaps g1–g9 in FIG. 2, sandwiched between the facets, form series capacitors which are necessary to form the zeroes as described above.

The funnel-shaped sections form parallel plate capacitors which are substantially less susceptible to capacitance changes than prior art, top printed duplex filters.

Figure 10:
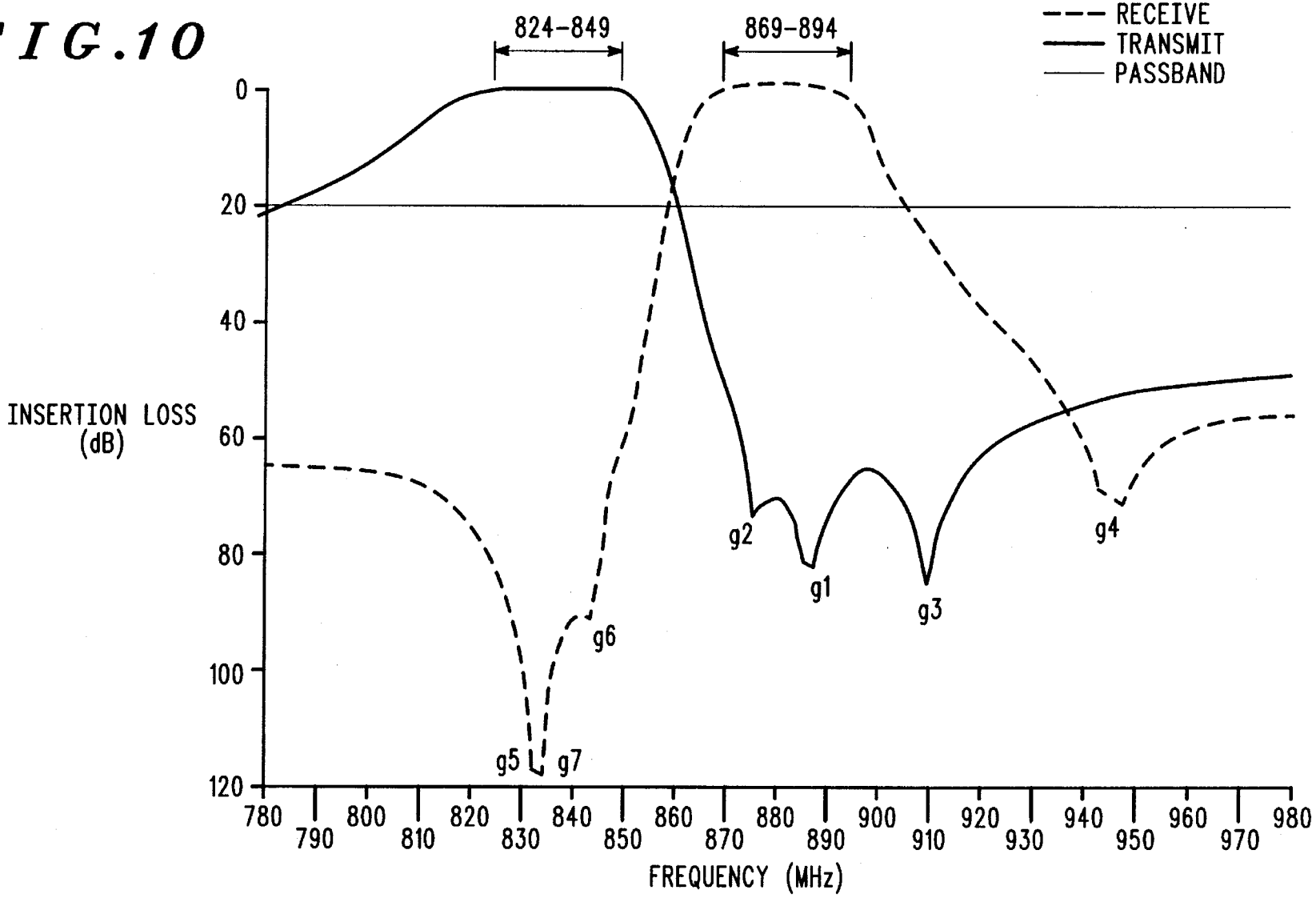
FIG. 10 is a frequency response of the duplex filter shown in FIGS. 6–8, in accordance with the present invention.

The distance from the top to the bottom surfaces 14 and 16 may be defined as length L of the filter body 12, and each of the receptacles 48 include a length of about one-sixth L or less, and preferably about one-tenth L or less, for the desired frequency response, such as that shown in FIGS. 5 and 10.

In one embodiment, the distance L from the top to the bottom surfaces 14 and 16, defines less than about a quarter wavelength. However, the presence of the receptacles near the top surface adds the necessary lumped capacitive loading, to provide a predetermined bandpass response at a predetermined frequency, typical of a quarter wavelength resonant structure. As should be understood by those skilled in the art, quarter wavelength, half wavelength, and the like resonant structures can be made without departing from the teachings of this invention.

The embedded capacitive devices 94, 96 and 98, correspond to a receiver coupling capacitor, antenna coupling capacitor and a transmitter coupling capacitor each having a predetermined value to contribute to providing a desired bandwidth. In one embodiment, each of these capacitors has a value ranging from about 0.5 picofarads (hereafter pf) to about 5 pf, and preferably about 1 pf to about 3 pf for UHF frequencies.

The capacitive values of the embedded devices 94, 96 and 98 are defined by a surface area of the respective conductive layers 95, 97 and 99 therein and the distance from the devices 94, 96 and 98 to the respective adjacent through-holes 28, 40 and 46.

This structure provides a durable and robust means of coupling to and from the filter, and further, the embedded devices are formed at the same time that the dielectric filter body 12 is formed, to provide precise dimensions and values. Advantageously, this structure minimizes or eliminates the need for precise positioning of screen printing and conductive gaps on the top surface, as in the prior art.

In a preferred embodiment, each of the capacitive devices 94, 96 and 98 includes at least a portion which is substantially concentric and complimentarily configured with respect to one of the respective adjacent through-hole 28, 40 and 46 to provide a more portable and compact overall structure.

The plurality of receptacles, defined as receptacles 50, 52, 54, 56, 58, 60, 62, 64, 66 and 68, are generally funnel shaped and are positioned adjacent to the top surface 14, to define a series capacitance sufficient to provide a desired bandpass response and desired zeroes, as shown for example in FIG. 5.

More particularly, each receptacle includes one or more conductive layers bounded by an adjacent vertical surface and one or more horizontal surfaces, for providing the desired capacitive value.

In more detail, each conductive layer 72, 74, 76, 78, 80, 82, 84, 86, 88 and 90 includes a conductive layer adjacent to and bound by the respective vertical wall and horizontal floor 72' and 73, 74' and 75, 76' and 77, 78' and 79, 80' and 81, 82' and 83, 84' and 85, 86' and 87, 88' and 89, and 90' and 91, respectively. The series capacitors in FIG. 4, are substantially defined as C14, C15, C16, C17, C18, C19, C20, C21 and C22. They are physically located between adjacent receptacles, and are substantially defined by the gap areas between between the adjacent through-holes, in FIGS. 1–4.

The series capacitances C14–C22, are defined in part by the above conductive layers, and are bound by the vertical walls and horizontal floors, and gap areas between each receptacle. Each of the plurality of series capacitors can range widely. In a preferred embodiment, each series capacitor ranges in value from about 0.1 pf to about 5 pf, for providing the desired frequency response.

In the embodiment shown in FIG. 1, the capacitive devices 94, 96 and 98 are coupled to the receiver, antenna, and transmitter from or adjacent to the top surface 14, through a transmission line, conductive material, etc. (not shown in FIG. 1) or in any suitable manner. The device shown in FIG. 1 may require additional connecting probes to attach it to a circuit board or external circuitry. This may be a preferred embodiment when the length L is substantially smaller than the W width dimension, as in higher frequency applications, such as 2 GHz or above relating to personal communications devices, etc.

In FIG. 2, the capacitive devices 94, 96 and 98 are electrically connected to receiver, antenna and transmit pads 100, 102 and 104 for direct surface mounting. The device shown in FIG. 2 can be surface mountable directly onto a circuit board, for example. This configuration may be preferable when the length L is the same or larger than the W width dimension, for example.

The duplex filter 10 can also include a number of ground recesses to provide a predetermined frequency response.

The ground recesses can be adjacent to the top 14 and side surfaces 18, 22 and 24 for the desired pole frequency, for adjusting the transmit (Tx) and receive (Rx) filter center frequencies. The conductive coatings on each ground recess is connected to the metallized layer 25 (or electrical ground for the filter 10). This structure provides predetermined shunt capacitors, for adjusting the center frequencies of the Tx and Rx filters.

More specifically, as shown in FIGS. 1 and 3, a right side ground recess 108 is shown which provides capacitor C1 in FIG. 4. A first rear ground recess 110 is positioned adjacent to the tenth through-hole and tenth receptacle 46 and 68, respectively to provide capacitor C2. The second rear recess 112 is positioned adjacent to the ninth through-hole 40, and receptacle 66 to provide capacitor C4. The third and fourth rear recesses 114 and 116 are positioned and aligned adjacent to the eighth and seventh through-holes and receptacles 64 and 62, to provide capacitors C6 and C7. The fifth rear recess 118 is aligned and configured adjacent to the fifth through-hole and receptacle 58 to provide capacitor C9. The sixth rear ground recess 120 is positioned and aligned adjacent to the fourth through-hole and receptacle 56 to provide capacitor C10. The seventh rear recess 122 is adjacent to the third through-hole and receptacle 54 to provide capacitor C11. The eighth rear recess 124 is positioned, configured and aligned with the first and second through-holes and receptacles 50 and 52 for providing capacitors C13 and C12, respectively. More particularly, the eighth rear recess 124 includes a first section 126 and a second section 128 adjacent to the second and first receptacles 52 and 50, respectively, which may have the same or different dimensions. Additionally, first and second front recesses on 130 and 132 are positioned and aligned adjacent to the eighth and ninth receptacles 64 and 66, to provide capacitors C5 and C3.

Capacitors C1–C6 of FIG. 4, set the pole frequencies, and hence the passband of the $T_x$ filter of FIG. 5. The capacitor C7 sets the antenna resonator frequency. And, capacitors C8–C13 set the pole frequencies and hence the passband of the $R_x$ filter of FIG. 5.

In a preferred embodiment, the ground recesses include at least a metallized horizontal section and a metallized vertical section connected to ground, the vertical section being substantially parallel and aligned with a portion of a respective adjacent through-hole, to provide the desired shunt capacitance.

The plurality of through-holes include receiver through-holes corresponding to the first through fifth through-holes 28, 30, 32, 34 and 36. The plurality of through-holes also include an antenna through-hole or seventh through-hole 40, and the transmitter through-holes are provided by the eighth, ninth and tenth through-holes 42, 44 and 46, respectively.

In one embodiment, the receiver through-holes 28, 30, 32, 34, 36, and 38 are smaller than the antenna and transmitter through-holes provided by items 40, 42, 44 and 46. In a preferred embodiment, the cross-section of the through-holes is substantially elliptically shaped to provide the desired frequency response and compact overall design of filter 10, but circular, rectangular, etc. cross-sectioned holes are possible as well. This provides a compact structure in order to obtain the desired frequency characteristics, while using the parallel-piped structure of the filter body 12. With the dimensions length L, width W and height of the body 12 set constant, making the $T_x$ and antenna through-holes larger than the $R_x$ through-holes, provides a minimal insertion loss (or less insertion loss) in the $T_x$ filter, which is a desirable feature in radios, wireless and cellular phones, for example.

In FIG. 2, the receiver, transmitter and antenna coupling devices 94, 96 and 98 are connected to input-output pads 100, 102 and 104. The pads 100, 102 and 104 include an area of conductive material disposed on the front side surface 20 and surrounded by dielectric material, to insulate the input-output pads from the metallized layer 25. This provides a surface mountable duplex filter.

A duplex filter equivalent circuit is shown in FIG. 4. The duplex filter comprises a transmit ($T_x$) filter and a receive ($R_x$) filter. The $T_x$ filter has three parallel resonant circuits including: inductor L1 and capacitors C1 and C2; inductor L2, and capacitors C3 and C4; and inductor L3 and capacitors C5 and C6, capacitors C1–C6 each being connected to ground, to form three poles. These poles are placed at predetermined frequencies to form a preferred $T_x$ bandpass response, substantially as shown in FIG. 5.

There are three transmission zeroes formed by inductor L19 and capacitor C22, inductor L18 and capacitor C21 and inductor L17 and capacitor C20, which are placed in the stop band region, to increase attenuation at the desired frequencies, as shown in FIGS. 4 and 5.

Inductor L4 and capacitor C7 set the antenna pole frequency.

The $R_x$ filter has six poles formed by: inductor L5 and capacitor C8; inductor L6 and capacitor C9; inductor L7 and capacitor C10; inductor L8 and capacitor C11; inductor L9 and capacitor C12; and inductor L10 and capacitor C13, which set the $R_x$ bandpass response.

The six transmission zeroes formed by the following, are placed on either side of the $R_x$ passband to increase attenuation at predetermined frequencies: inductor L16 and capacitor C19; inductor L15 and capacitor C18; inductor L14 and capacitor C17; inductor L13 and capacitor C16; inductor L12 and capacitor C15; and inductor L11 and capacitor C14.

Capacitor C23 couples the transmitter to the input of the transmit filter. The capacitor C24 couples the output of the transmit filter and the input of the receive filter which are tied together via the antenna resonator, to a single antenna, indicated as ANT in FIG. 4. And, capacitor C25 connects the receive filter output to a receiver in a radio, cellular phone, etc., for example.

The frequency responses in FIG. 5 are essentially self explanatory. The zeroes are strategically placed at certain frequencies to increase attenuation of certain undesired frequencies.

The gaps g6, g2 and g4 are provided to create zeroes (or additional atenuation) of the Rx filter in the transmit band.

The gaps g5 and g3 provide zeroes (or additional attenuation) for the Rx filter in the local oscillator band (or stop band), around 914 MHz or above, for example.

The gap g1 provides a zero for additional attenuation for the Rx filter in the Tx image band, (i.e., approximately 940–960 MHz range).

The gaps g9, g8 and g7 are provided to create zeroes for the Tx filter in the receiver band to minimize transmitter noise interference with the receiver.

Referring to FIGS. 6, 7 and 8, another embodiment of a duplex filter 210 is shown. This filter 210 includes much of the same structure as previously described in FIGS. 1–3, (similar item numbers have been used throughout to describe similar structures, for example, filter 10 and 210, body 12 and 212, etc.).

The duplex filter 210 shown in FIGS. 6–8, includes a filter body 212 comprising a block of dielectric material having top, bottom and side surfaces 214, 216 and 218, 220, 222 and 224, respectively. The filter body 212 has a plurality of through-holes extending from the top to the bottom surface 214 to 216, with an upper portion of the through-holes defining a receptacle suitably configured and having a sufficient depth to receive a conductive material. The exterior surfaces 216, 218, 220, 222, and 224 are substantially covered with a conductive material defining a metallized layer 225, with the exception that the top surface 214 is substantially unmetallized. Also unmetallized, is at least one uncoated area 211 of dielectric material on the side surface 220 surrounding the input-output pads. Each of the receptacles adjacent to and spaced below the top surface 214, includes a conductive layer of material sufficient to provide a predetermined capacitance. And, the duplex filter 210 further includes first, second and third input-output pads 300, 302 and 304 which include an area of conductive material disposed on one of the side surfaces, preferably side surface 220, and surrounded by a dielectric or insulative material such as uncoated areas 211.

The instant duplex filter 210 provides a surface mountable duplex filter, which is more compact and portable, and can be manufactured more easily and cost effectively, than the prior art. Additionally, this invention does not require top printing, a bottom grinding step, and re-electroding, which is required for frequency adjustment of prior art duplexers, which greatly simplifies the manufacturing process flow and tuning, over prior art duplex filter designs having top print structures.

In the embodiment shown in FIGS. 6–8, the receptacles 250, 252, 254, 256, 258, 260, 262, and 264 include substantially planar vertical side walls 272', 274', 276', 278', 280', 282', 284' and 286' and substantially planar horizontal floor sections 273, 275, 277, 279, 281,283, 285 and 287 having a port on the respective floor leading to the remainder of the respective through-holes, for obtaining the desired frequency response, as shown for example, in FIG. 10 and a compact design.

Referring to FIG. 4, if the C21, L18, C22, L19 were shorted and L9, C12 and L10, C13 were open circuited, generally this schematic would be equivalent to the invention shown in FIGS. 6–8. However, in the embodiment with lower receptacles 237, 239, 241 and 243, the equivalent circuit would further include several Malherbe coupled transmission line circuit representations.

In one embodiment, the side walls 272'–286' are slightly inclined from a vertical axis, such as about 15° from the vertical axis or less, preferably about 10°, for simplifying the manufacture and forming of the ceramic filter body 212.

The horizontal floor sections 273–287 of the receptacles are substantially horizontal, for receiving and facilitating the metallization or placing a conductive layer therein and thereon. This structure provides capacitive couplings between the receptacles 250–264 to the metallized lawyer 225 (or ground), for contributing to provide a preferred frequency response substantially as shown in FIG. 10.

In one embodiment, a horizontal (component) portion of the substantially vertical side walls 272" and 286" in FIGS. 6 and 8 of the receptacles 250 and 264, adjacent and parallel to the first and the third input-output pads 300 and 304 on the front surface 220, include a larger surface area than the similar portions of the side walls of the other receptacles 252–262 not adjacent to the input-output pads. In a preferred embodiment, the horizontal component of walls 272" and 286" is laterally wider than the others not adjacent to receptacles 250 and 264, to provide the desired capacitive coupling between the receptacles 250 and 264 and input-output pads 300 and 304. This is done to improve the input and output capacitive couplings between the respective resonator sections and the input-output pads 300 and 304. This structure provides a larger capacitive coupling for providing a desired passband with a suitable bandwidth.

In one embodiment, a vertical (depth) component of the second input-output pad (or antenna pad) 302 is longer than the same vertical component of the first and third input-output pads 300 and 304, for coupling to both the receiver and transmitter frequencies. Since the antenna input is common to both the receiver and transmitter, it should pass the transmitted and received signals with minimal loss and the passband should suitably pass the $T_x$ and the $R_x$ passbands. Thus, the vertical component of the second pad 302 provides a larger capacitive value and a larger and longer conductive pad to provide the desired coupling.

Each receptacle 250, 252, 254, 256, 258, 260, 262 and 264 is carefully configured to provide a predetermined capacitive coupling to at least one or more adjacent receptacles and the metallized layer on the exterior surfaces defining ground, for providing the desired frequency characteristics.

Receptacle 250 provides the desired capacitive loading for the first resonator circuit of the $T_x$ filter, the desired coupling to the transmitter pad 300 and the capacitive coupling between the first and second receptacles 250 and 252. The receptacle 252 provides capacitive loading for the second resonator and the desired first to second resonator coupling and the second to third resonator coupling capacitances. The receptacle 254 provides the desired capacitive loading for the third resonator, and provides a predetermined second to third and third to antenna resonator coupling capacitance. The receptacle 256 provides the desired capacitive loading for the antenna resonator, and provides a predetermined coupling to the antenna pad 302, and the third to the antenna and the antenna (fourth receptacle) resonator coupling capacitance to the fifth resonator. The receptacle 258 provides a predetermined capacitive loading from the fourth resonator to the fifth and the fifth to the sixth resonator coupling capacitance. Likewise, the receptacles 260 and 262 provide similar capacitive couplings, as detailed above. The receptacle 264 provides desired capacitive loading to the resonator, and provides the desired coupling between the eighth resonator 264 and the receiver pad 304. Gaps g1, g2, g3, g4, g5, g6 and g7 define the gap area of dielectric material between adjacent receptacles, for substantially providing the desired capacitive coupling between such adjacent receptacles.

The plurality of receptacles have a depth which can vary widely, for example a depth of about one-fifth or less of the length L of the filter body 212, as defined as the distance from the top to the bottom surface 214 to 216, and preferably is about one-tenth of the length L for the desired frequency response. Large electrical fields occur at or near the top surface 214 of the ceramic block between the conductive receptacles and the conductive outer walls (metallized layer 225) of the filter body 212. The field intensity (or activity) diminishes traveling down from the top surface 214 through the depth of the receptacles. As the depth of the receptacle is increased beyond 1/10 of the length L, the capacitive loading efficiency is decreased. Preferably, the depth of each receptacle is about 1/10 of the length L. Stated another way, it is believed that more than 70% of the maximum potential loading capacitance of the receptacle is realized by a receptacle of about 1/10 of the length L deep, or less. Further, a receptacle with this depth of about 1/10 of the length L, can be reliably manufactured.

Figure 9:
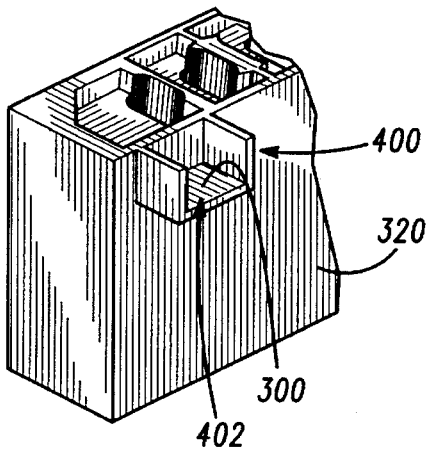
FIG. 9 is a partial view of an alternate embodiment, showing an input-output pad for certain applications, made in accordance with the present invention.

In one embodiment, as shown in FIG. 9, the input-output pads 300, 302 and 304 can extend outwardly 400 from the side surface 320 with a recess 402 of conductive material defining pads 300, 302 and 304. This structure provides the advantages of facilitating input-output connections in certain applications. This would not require a metallized side print and the duplex filter could be manufactured in a simplified process.

The depth of the plurality of receptacles 250–264, defined as the distance from the top surface 214, are substantially similar, for ease of manufacture.

In one embodiment, one or more receptacles can include different depths to increase capacitive loading for that cell, but not increasing inter-cell capacitive coupling.

Referring to FIGS. 6 and 7, some of the receptacles have four or more vertical side walls, as viewed from the top surface 214, for the desired frequency characteristics and compact design. The particular shape and configuration of each receptacle is determined by the desired capacitive loading, capacitive coupling to the input-output pads, and the desired resonator to resonator coupling capacitances. Each receptacle usually includes about 4 vertical side walls. The geometric shape can vary for each receptacle, and is generally determined by the desired frequency characteristics, and desired dimensions of the filter 210 and manufacturing considerations.

As shown in FIGS. 7 and 8, at least some of the through-holes have substantially the same geometric shapes throughout. The cross-section of the through-holes is substantially elliptical for the desired frequency characteristics and dimensions of the filter 210. For example, the transmit through-holes defined as the first, second and third through-holes 228, 230 and 232 and the antenna through-hole 234 have substantially the same geometric shape, from the receptacle or upper portion of the through-hole where it meets the respective receptacle to the bottom surface 216, for ease of manufacture, tooling and the desired frequency response.

In FIG. 6, at least some of the through-holes have substantially different geometric shapes, for example the receive (Rx) through-holes, defined as the fifth, sixth, seventh and eighth through-holes 236, 238, 240 and 242 include flared out substantially funnel-shaped bottom sections 237, 239, 241, and 243, respectively.

By making the Rx through-holes larger near the bottom surface 216 (or including the flared out geometry), than those of the Tx through-holes, an improvement in the unloaded resonator Q of the Rx resonators can be improved, and the operating frequency of the Rx resonators can be made higher than the operating frequency of the Tx resonators. Since a duplexer has two operating bands, when designed with this feature, the side with the higher operating band will have the flared out sections 237, 239, 241 and 243. The antenna through-hole 234 is chosen to have the same through-hole cross-section as those of the Tx through-holes 228, 230 and 232, for ease of manufacture and providing the desired frequency response characteristics, substantially as shown in FIG. 10, for example.

In one embodiment, at least some of the through-holes are not equally spaced apart from adjacent through-holes. For example, the following through-holes are not equally spaced apart from adjacent through-holes, for optimizing the final frequency response and the desired dimensioning. For example, the Tx filter through-holes are spaced closer together, to provide a wider bandwidth and the Rx filter through-holes are spaced slightly farther apart from adjacent through-holes to increase attenuation in the stop bands. This feature can contribute to optimizing the design, providing better electrical performance for a defined volume or size. Stated another way, varying the spacing between the resonator through-holes can contribute to reducing the receptacle shape and complexity, and facilitate in the manufacture of the filter body 212.

As shown in FIG. 8, at least some of the through-holes in proximity to the bottom surface 216 include a bottom receptacle (flared out sections 237, 239, 241 and 243), with a conductive outer layer. In a preferred embodiment, the bottom receptacle is generally flared outwardly and downwardly (or generally funnel-shaped). The flaring out of these through-holes is to push the operating frequency of these receptacles higher. Stated differently, the through-holes with the flared out geometrical shapes, will resonate at a higher frequency than those without it.

In FIG. 7, the fifth, sixth, seventh and eighth through-holes 236, 238, 240 and 242, includes bottom receptacles 237, 239, 241 and 243, for the reasons detailed above.

More specifically, some of the through-holes define transmit (Tx) through-holes 228, 230 and 232, the fourth through-hole is the antenna through-hole 234, and the fifth, sixth, seventh and eighth through-holes 236, 238, 240 and 242 define the receiver (Rx) through-holes. The receiver through-holes 236, 238, 240 and 242 have bottom receptacles 237, 239, 241 and 243, respectively, having larger diameters than the through-holes themselves, thereby raising the effective receiver frequency, as detailed above.

The receiver band bottom receptacles 237, 239, 241 and 243 decrease the effective length of the through-holes 236, 238, 240 and 242, thereby raising the receiver filter frequency. This is so because the resonant frequency of a quarter wavelength resonator structure is inversely proportional to its length, defined as item L in FIG. 6.

A shielding device 410 comprised of a metallic material or equivalent can be used for minimizing leakage, rejecting out of band signals and improving insertion loss of inband signals, can be connected to the metallized layer 225 by solder reflow, for example, as illustrated in FIG. 6.

The frequency characteristics shown in FIG. 10 are quite similar to those detailed with respect to FIG. 5. The band-pass regions and zeroes are strategically placed for obtaining the desired characteristics. In a preferred embodiment, the invention is particularly adapted for use in connection with cellular telephones.

Figure 11:
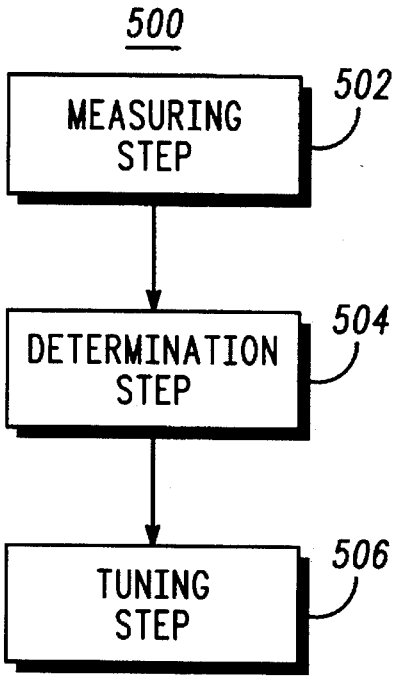
FIG. 11 is a block diagram of a method for tuning the duplex filter, in accordance with the present invention.

Referring to FIG. 11, a method of tuning a duplex filter 500 is shown in its most simplified form. The method can include: (i) a measuring step 502, measuring the center frequency of at least one filter of a duplex filter; (ii) a determining step 504, determining the difference between the measured center frequency and a desired center frequency; and (iii) a tuning step 506, tuning the frequency characteristic of the filter by selectively removing a substantially planar layer of dielectric material from a top portion of the filter, for adjusting the frequency characteristic of the filter. In a preferred embodiment, the frequency characteristics substantially as shown in FIGS. 5 or 10 would be obtained, for example. In this method, a planar portion of the top surface 14 and 214 is removed, which is easily lapped, machined, or ground off the filter body. The tuning step 506 is particularly adapted to being automated, which is advantageous from a manufacturing standpoint because costs can then be reduced. However, it can also be done manually.

The duplex filter referred to herein can include the duplex filter 10 or 210, in FIGS. 1–4 and 6–8. Both duplex filters 10

(and 210) have a transmit filter and a receive filter. In one embodiment, at least one of the filters is adjusted by selectively removing a substantially planar layer of dielectric material from a top portion or surface 14 of the duplex filter 10 in proximity to the transmitter filter, receiver filter or both. Stated differently, this step allows an operator to selectively adjust the frequency characteristic of either the transmit filter, receiver filter, or both. This feature can help to improve the manufacturing production yield and can facilitate the customizing of duplexers for different customer specifications. This method can provide a filter design that can correct minor, previous manufacturing errors, and produce a more consistent group of duplex filters, than those obtainable in prior art methods.

The tuning step 506 in this method, can include independently tuning the transmit and receive filters to the same or different lengths. With the ability to independently tune the transmit and/or receive filters, to the same or different lengths, a customized duplex filter can be produced on the fly, during manufacturing, for different operating frequency bands. Tuning automation can be facilitated and simplified by this method.

The tuning step 506 can include tuning both filters of the duplex filter substantially simultaneously or at different times, preferably simultaneously for an improved tuning rate and reduction of cycle time. However, if errors are introduced or adjustments are needed in the manufacturing process, it may be more advantageous to tune at different times, or rework one or both filters in the duplex filter, for example.

The tuning step 506 can include adjusting each filter length, defined by the distance from the top to the bottom surface 14 to 16, in one pass, or more than one pass, by lapping, grinding and/or removing a planar top portion of the top surface 14.

Figure 12:
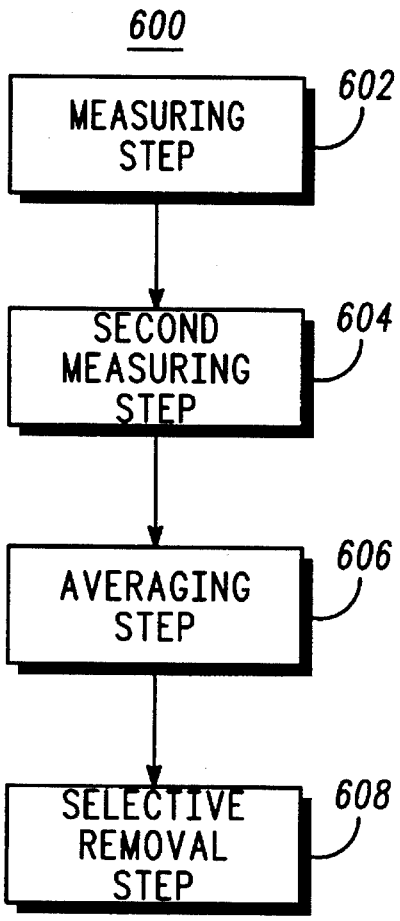
FIG. 12 is a block diagram of an alternate method for tuning the duplex filter, in accordance with the present invention.

Referring to FIG. 12, in another embodiment, the method of tuning a duplex filter 600 can include the following steps. A first measurement step 602 can include measuring the center frequency of a first filter. A second measurement step 604 can include measuring the center frequency of a second filter. The third step can include an averaging step 606 which involves averaging the center frequencies of the first and second filters in the first and second steps 602 and 604, to obtain a predetermined measurement. And, the fourth step or the selective removal step 608, can include selectively removing a substantially planar layer of a top surface 14 of the duplex filter 10, for adjusting the frequency characteristics of the duplex filter based on the averaging step, average measurement. This method is particularly adaptable to automation, which can contribute to higher yields and improved performance of duplex filters, as detailed herein.

The averaging step can include weighing one of the center frequencies more than the other. For example, the receive filter can be weighed at 1.1 times that of the transmit (or second) filter frequency. The weighted average step is particularly advantageous in cases where the two constituant center frequencies are significantly apart. The weighed average step provides that one of the two filters will be adjusted differently than the other, thereby resulting in a desired non-uniform tuning of the duplexer.

EXAMPLE 1

Several duplex filters have been made substantially as shown in FIG. 2. The following is a description of how these filters were tuned.

Let the desired transmit center frequency be equal to $F_{tx}$. Let the desired receive center filter frequency be equal to $F_{rx}$. And, let the average desired duplex frequency be equal to $F_{avg}$, where $F_{avg}$ equals $(F_{tx}+F_{rx})/2$ MHz.

The first step consisted of calculating $F_{avg}$. This frequency is fixed or constant for the particular product or duplexer. The duplex filters in Example 1 were made for use in the domestic cellular telephone market. The desired frequency response is substantially as shown in FIG. 5.

The second step includes measuring the block length L'. This measurement is equivalent to the length L in FIG. 2.

The third step involves measuring the transmit center frequency, which is designated as $F'_{tx}$. This is an actual measurement made on each duplex filter.

The fourth step involves measuring the receive center frequency, which is equal to $F'_{rx}$. This is also an actual measurement taken for each duplex filter.

The fifth step involves calculating the average duplex frequency, which is designated as $F'_{avg}$, whereby $F'_{avg}=(F'_{tx}+F'_{rx})/2$ MHz. This frequency is usually lower than that desired, so that an appropriate (or suitable) layer of ceramic can be removed from the top of the filter body. It is difficult if not impossible to add ceramic material to a filter block, as shown in FIG. 2.

In step six, the desired length of the block, hereafter designated as L is calculated, whereby L equals $L'-(F_{avg}-F'_{avg})/R$ mils, where R is the rate of removal of the ceramic, which can be decided emperically, theoretically or both, expressed in MHz per mil. In a preferred embodiment, R is determined empirically for the desired duplex filter and can be modified for process variations.

In step seven, the top surface of the filter body of the duplexer in FIG. 2 is ground away. More particularly, a substantially uniform and substantially planar layer of ceramic from the top surface (item 14 in FIG. 2) of the filter body is ground away, to decrease the length to L in step 6 above.

More particularly, in step seven decreasing L will decrease substantially every capacitor (C1–C25) in FIG. 4, thereby increasing the transmit filter center frequency from $F'_{tx}$ to $F_{tx}$ and the receive filter center frequency from $F'_{rx}$ to $F_{rx}$. Stated another way, step 7 adjusts the measured center frequencies to the desired center frequencies to resemble the desired response.

Several duplex filters for the domestic cellular telephone market have been tuned successfully as described above, using the above values and formulas. Many duplex filters, as shown in FIG. 2, have been tuned in the above described manner.

EXAMPLE 2

In this example, all of the steps described in Example 1 were followed. Example 2 is particularly directed to tuning one particular duplexer for the domestic cellular telephones. $F_{tx}$=836.5 MHz, $F_{rx}$=881.5 MHz and $F'_{avg}$ equals (836.5 and 881.5)/2, equaling 859 MHz. This corresponds to step one.

The dielectric constant of the ceramic (barium titanate) was approximately 37.5. The rate of removal of R was experimentally derived at being equal to 3.5 MHz per mil.

In step 2, L'=525 mils, and in steps 3 and 4, $F'_{tx}$=825 MHz and $F'_{rx}$=870 MHz were the measured values, respectively.

Thus, in step 5, $F'_{avg}$=847.5 MHz. Therefore, using the formula in step 6, L=525–(859–847.5)/3.5=521.7 mils. This means a layer of 3.3 mils thick of ceramic was removed (ground off) of the top surface, to come up with the frequency curves in FIG. 5.

EXAMPLE 3

The following description is a process flow of a method of tuning a duplex filter, which it is believed would work for all of the duplex filters of the invention, and is particularly adapted to the duplex filter shown in FIGS. 6 through 8.

The first step would involve measuring the frequency response (including a predetermined center frequency), of each of the first and the second filter of the duplex filter.

The second step would involve recording the measurement in a suitable computer memory.

The third step involves comparing the measurement of the frequency response in step two with a known set of response curves stored in a computer database. If the measurement does not match any of the database response curves, then the duplex filter would be set aside and appropriately designated as needing further manual rework. The results of this manual rework can be incorporated into the database. If the measurement matched one of the computer database response curves as tunable, then the procedure would continue.

The fourth step would involve selectively removing one or several substantially planar layers from the top portion of the duplexer at predetermined locations, as determined by the computer program. For example, for a certain duplex filter model, the measurement would show that the second filter is at the desired frequency and the first filter is two MHz below the desired frequency, and both have response shapes that are passing (or within the computer database response curves as being tunable), then removal of a suitable planar layer of ceramic material would be undertaken. The area which is to be removed is defined such that it covers substantially all of the top surface adjacent to the first filter.

The fifth step involves measuring the frequency responses of the previously tuned filter in step 4, to compare this response to the computer database response curve. If the duplex filter does not need further tuning, the computer will appropriately signify that suitable frequency characteristics have been met. This duplex filter can then be appropriately sorted as meeting certain requirements.

As more duplex filters are tuned for certain models, the computer database for that model is improved and expanded, and thus will cover more response curves. The specific tuning action is set based on this empirical data (expanding data base of information).

The instant method can provide a reduction in the number of process steps necessary to make reliable duplex filters. This can translate into a reduction in cycle time, improved performance and costs, and more reliable, reproducable filters. In contrast, in many prior art devices, adjustment of the frequency is accomplished by removing a layer of ceramic off the bottom of the filter block, which is inductive tuning. This inductive tuning requires at least three or more steps. For example, adjust the length, by removing conductive coating from the bottom, removing a ceramic layer from the bottom, and reapplying conductive coating on the bottom (a wet process) and retiring the material to remove unwanted solvents (from the wet process).

The instant method involves only one step of selectively removing a planar layer of the ceramic material, thereby reducing cycle time, costs and improving efficiency and reliability.

Also in contrast to the prior art method, the instant method involves capacitive tuning of the capacitors in FIG. 4, by appropriate tuning and removal of a planar top layer of ceramic material on the duplex filter of this invention. Another advantage of this invention is that the tuning method saves conductive material, which often is one of the most expensive components of the filter.

Although the present invention has been described with reference to certain preferred embodiments, numerous modifications and variations can be made by those skilled in the art without departing from the novel spirit and scope of this invention.

What is claimed is:

1. A method of tuning a duplex filter comprising the steps of:

providing a duplex filter having a first filter and a second filter and surface mountable input-output pads;

measuring a center frequency of the first filter;

measuring a center frequency of the second filter;

averaging the center frequencies of the first and second filters to obtain an average frequency measurement; and based on the average measurement, selectively removing a substantially planar, dielectric layer of a top surface of the duplex filter, for providing a predetermined frequency response of the duplex filter.

2. The method of tuning a duplex filter of claim 1, wherein the averaging step includes weighing one of the center frequencies more than the other of the center frequencies by use of a numerical factor such that one of the filters is adjusted to have a different length than the other of the filters.

3. The method of tuning a duplex filter of claim 1, wherein the removing step includes selectively removing a substantially planar layer of dielectric material from the top portion of the duplex filter in proximity to the receive filter.

4. The method of tuning a duplex filter of claim 1, wherein the removing step includes selectively removing a substantially planar layer of dielectric material from the top portion of the duplex filter in proximity to the transmit filter.

5. (Twice amended) The method of tuning a duplex filter of claim 1, wherein the removing step includes independently tuning the transmit and receive filters to have different lengths.

6. The method of tuning a duplex filter of claim 1, wherein the removing step includes adjusting each filters length, whereby a length of the transmit and receive filter is different, the length is defined as the distance from the top portion to a bottom portion of the duplex filter.

* * * * *